US005625924A

United States Patent [19]

Sauter et al.

[11] Patent Number: 5,625,924

[45] Date of Patent: May 6, 1997

[54] METHOD FOR PRODUCING A CARD SLIVER AND CARDING MACHINE THEREFOR

[75] Inventors: Christian Sauter, Flurlingen; Jurg Faas, Dinhard, both of Switzerland

[73] Assignee: Maschinenfabrik Rieter AG, Winterthur, Switzerland

[21] Appl. No.: 508,704

[22] Filed: Jul. 28, 1995

[30] Foreign Application Priority Data

Jul. 29, 1994 [CH] Switzerland ..... 02402/94

[51] Int. Cl.[6] ..... D01G 15/28; D01G 7/14

[52] U.S. Cl. ..... 19/103; 19/102; 19/98

[58] Field of Search ..... 19/98, 99, 100, 19/101, 102, 103, 104, 105, 106, 107, 108, 110, 113, 114

[56] References Cited

U.S. PATENT DOCUMENTS

| | | | |
|---|---|---|---|
| 453,060 | 5/1891 | Canning | 19/103 |
| 528,070 | 10/1894 | Meats | 19/103 |
| 564,125 | 7/1896 | Tweedale et al. | 19/103 |
| 5,040,272 | 8/1991 | Fritzsche | 19/104 |
| 5,054,166 | 10/1991 | Demuth et al. | 19/108 X |
| 5,065,637 | 11/1991 | Soltermann et al. | 19/106 R X |
| 5,247,721 | 9/1993 | Demuth et al. | 19/107 X |
| 5,271,125 | 12/1993 | Leifeld et al. | 19/103 |
| 5,355,560 | 10/1994 | Fritzsche et al. | 19/98 |
| 5,398,381 | 3/1995 | Schlichter et al. | 19/102 |

FOREIGN PATENT DOCUMENTS

| | | | |
|---|---|---|---|
| 0384297 | 8/1990 | European Pat. Off. . | |
| 0446796 | 9/1991 | European Pat. Off. . | |
| 0497736 | 8/1992 | European Pat. Off. . | |
| 0565486 | 10/1993 | European Pat. Off. . | |
| 0627508 | 12/1994 | European Pat. Off. . | |
| 229595 | 5/1909 | Germany . | |
| 3601906 | 8/1987 | Germany | 19/103 |
| 4115960 | 11/1992 | Germany . | |
| 9313633 | 2/1994 | Germany . | |
| 4235610 | 4/1994 | Germany . | |
| 3011 | of 1887 | United Kingdom | 19/103 |
| 9533875 | 12/1995 | WIPO . | |

OTHER PUBLICATIONS

Patent Abstracts of Japan, vol. 13, No. 575 (C–667).

*Primary Examiner*—John J. Calvert

*Attorney, Agent, or Firm*—Greenblum & Bernstein P.L.C.

[57] ABSTRACT

Method for producing a card sliver and carding machine therefor. The flexible bend of a card is set automatically by the machine control by means of a controllable actuator system on the basis of a wear characteristic, this characteristic representing the wear as a function of the production of a given material.

20 Claims, 6 Drawing Sheets

METHOD FOR PRODUCING A CARD SLIVER AND CARDING MACHINE THEREFOR

CROSS REFERENCE TO RELATED APPLICATIONS

This application claims the priority of Swiss Application No. CH 02 402/94-0, filed Jul. 29, 1994, the disclosure of which is incorporated herein by reference in its entirety.

BACKGROUND OF THE INVENTION

1. Field of the Invention

The invention pertains to a method for producing a card sliver using a carding machine including working elements wherein the condition of the working elements deteriorates as the machine operating time increases, the method comprising periodically resetting the working elements for the purpose of compensating, at least partially, the deterioration in the condition of the working elements; and a carding machine for carrying out this method.

2. Discussion of the Background of the Invention and Material Information

On each side of a conventional revolving flat card there is a so-called flexible bend which can be adjusted relative to the corresponding side shield for the purpose of setting the carding gap (between the clothing of the flat bars and the carding cylinder clothing). This adjustment can be made manually, according to German Utility Model DE-Gbm 9313633.

It is also known, in the case of modern revolving flat cards, for example in the case of Applicants' own C 50 card, that the quality of the produced card silver is checked at regular time intervals using a laboratory instrument. The card clothing teeth are visually assessed by the responsible foreman of the spinning operation. If the latter determines, on the basis of his inspections and the operating period, that the quality is falling below a predetermined standard, then the card must be stopped so that the teeth of the carding cylinder clothing, and also, if necessary, the flat clothing can be reground. This inspection task is frequently performed by the manufacturers of the card clothing within the context of service contracts.

Following the grinding it is necessary to reset the existing carding gap, which has been enlarged by wear and the grinding operation. Generally three to five setting elements are provided on the flexible bend for this purpose, on each side of the card. The carding gap is measured at different points by means of a blade gauge and then set. These tasks are known to be time-consuming and result in stoppage times of up to one day on a single card. Obviously, however, the spinning operation requires full utilization of the machine operating times and therefore seeks to minimize the stoppage times for inspection of the machines. For this reason, in many spinning operations this inspection work is not carried out until the last moment, i.e., when the quality of the produced card sliver is still only just adequate or is even already below the tolerance limit. In view of this unsatisfactory situation, Applicants have set forth various proposals for automatic grinding of the carding cylinder clothing in European Patent Applications EP-A-497736 and EP-A-0 565 486. The latter document, for example, provides for a controller for the application of a grinding element at periodic operating intervals. The use of automatic grinding enables the quality of the produced card sliver to be maintained over a certain period of time and within a defined tolerance range. However, it still remains necessary to reset the carding gap by hand.

It is the task or object of the present invention to further reduce the adjustment work on the card without adversely affecting the quality of the produced card sliver.

SUMMARY OF THE INVENTION

This task or object is achieved by a first embodiment of a method of this invention for producing a card sliver using a carding machine including working elements wherein the condition of the working elements deteriorates as the machine operating time increases, the method comprising periodically resetting the working elements for the purpose of compensating, at least partially, the deterioration in the condition of the working elements; and effecting the resetting of the working elements via a controllable actuator system.

In a further embodiment of the method of this invention, the resetting is initiated via a control.

Another embodiment of the method of this invention further includes providing the control with a control program for initiating the resetting on the basis of a wear characteristic, with the wear characteristic depending upon actual machine production.

In a differing embodiment of the method of this invention, the wear characteristic is also dependent on the characteristics of a material being processed in the machine.

In still a further embodiment of the method of this invention, the working elements are flat bars and clothing of a carding cylinder of a revolving flat card, with the method further including periodically regrinding the clothing of the carding cylinder, and automatically resetting a carding gap, between the clothings of the flat bars and the reground clothings of the carding cylinder.

In still another embodiment of the method of this invention, the working elements are flat bars and clothing of a carding cylinder of a revolving flat card, with the method further including periodically regrinding the clothing of the flat bars, and automatically resetting a carding gap, between the clothings of the flat bars and the reground clothing of the carding cylinder.

In still a differing embodiment of the method of this invention, the resetting involves setting points, with the setting points moving radially relative to the carding cylinder.

In yet a further embodiment of the method of this invention, the card includes opposed sides and the resetting is carried out in steps and involves setting points, with each setting point on one side of the card moving over the same path.

In yet another embodiment of the method of this invention, the resetting is achieved by readjusting at least one flexible bend.

A yet a differing embodiment of the method of this invention, further includes simultaneously readjusting the flexible bend at several points.

A first embodiment of the carding machine of this invention includes working elements and a mechanism for resetting the working elements for the purpose of compensating, at least partially, for a deterioration in the condition of the working elements, wherein a controllable actuator system is utilized for effecting the resetting.

In a further embodiment of the carding machine of this invention, the machine includes a control for initiating the resetting.

In another embodiment of the carding machine of this invention, the control includes a memory unit for entering a wear characteristic for the working elements, the memory unit being dependent on the machine production and the control, via the machine production and the actuator system, acting on a setting mechanism for the working elements for at least one of for automatically adjusting the working elements and for improving the working elements at time intervals determined by the control.

In a differing embodiment of the carding machine of this invention, the wear characteristic is also dependent on the characteristics of a material being processed in the machine.

A still further embodiment of the carding machine of this invention further includes an automatic grinding device, with the automatic grinding device regrinding the teeth of the clothing of the carding cylinder of a revolving flat card at time intervals determined by the control.

In a still another embodiment of the carding machine of this invention, the grinding is initiated by the control in dependence upon total machine production.

In still a differing embodiment of the carding machine of this invention, the control adjusts the setting elements of a flexible bend on the revolving flat card.

In yet a further embodiment of the carding machine of this invention, the card includes opposed sides and the actuator system simultaneously resets the control elements for each of the card sides.

In yet another embodiment of the carding machine of this invention, the actuator system of one card side includes a common drive for all setting elements of the one side.

In yet a differing embodiment of the carding machine of this invention, the actuator system includes at least one setting element, the setting element being subject to tensile loading during resetting.

This invention provides the significant advantage that the necessary readjustments on the working elements of the carding machine can be performed automatically, in a simple and cost-effective manner, in a timely manner and without additional inspection by the responsible foreman. This operation can be performed during the carding itself, thereby avoiding the otherwise necessary stoppage times and increasing the productivity of the carding machines. This is particularly important in the case of the capital-intensive revolving flat cards. The automatic resetting or readjustment also assures that the quality of the produced card sliver remains uniform and is not dependent upon the operating personnel.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have generally been used the same reference characters to denote the same or analogous components and wherein.

DETAILED DESCRIPTION OF THE PREFERRED EMBODIMENTS AND BEST MODE

With respect to the drawings it is to be understood that only enough of the construction of the invention and the surrounding environment in which the invention is employed have been depicted therein, in order to simplify the illustrations, as needed for those skilled in the art to readily understand the underlying principles and concepts of the invention.

Figure 1:
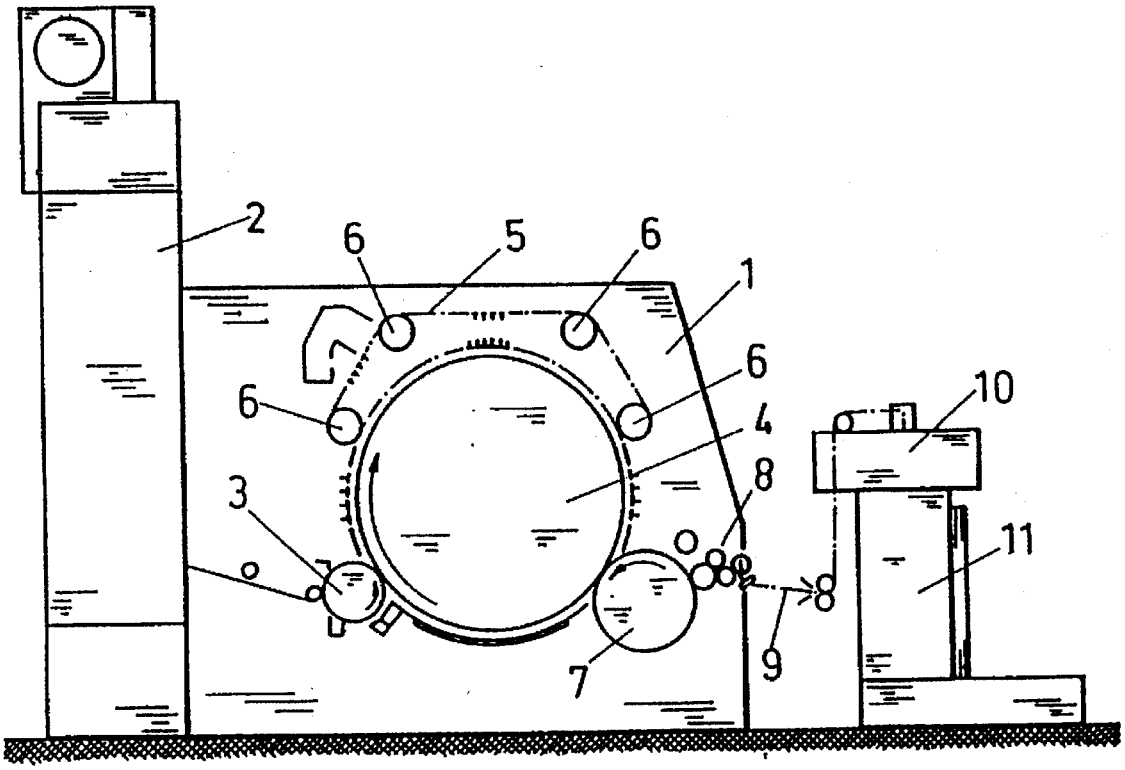
FIG. 1 shows a prior art revolving flat card, which serves as a reference for explaining the present invention.

FIG. 1 shows, in schematic form, a prior art revolving flat card 1, for example Applicants' own C50 card. The fiber material is fed into the feed shaft 2 in the form of opened and cleaned flakes, taken up by a licker-in 3 as lap feeding, transferred to a carding cylinder or drum 4 and parallelized by a revolving flat set 5 which is driven by deflection rollers 6 in a direction opposite to the direction of rotation of carding cylinder 4. Fibers from the web on carding cylinder 4 are then doffed by a doffing roller 7 and formed into a card sliver 9 in a delivery section 8 comprised of various rollers. This card sliver 9 is then delivered cycloidally from a coiler 10 into a transport can 11.

Figure 2:
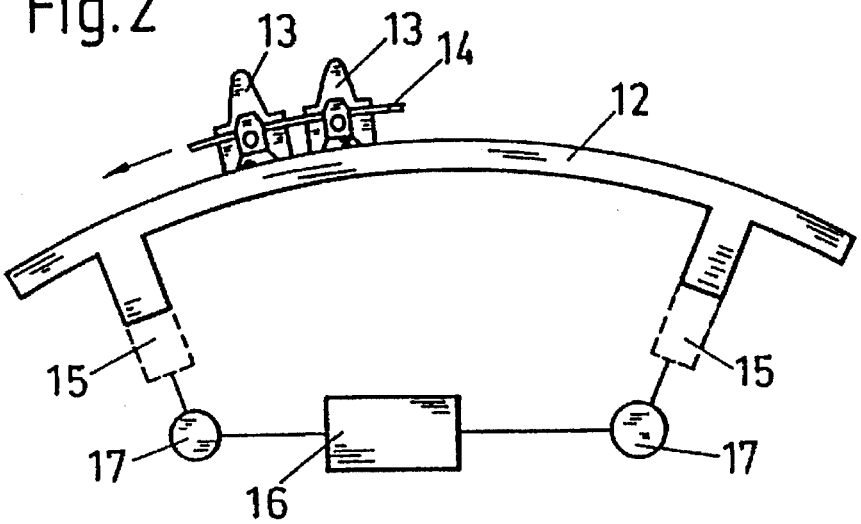
FIG. 2 shows, in schematic form, a flexible bend of a revolving flat card when the elements are adjusted by means of motors, and a controller, in accordance with the invention.

FIG. 2 shows a section of a flexible bend 12 of such a card, on which circulate revolving flats 12 (only two of which are shown) that are moved within or in a direction opposite to the direction of rotation of carding cylinder 4 by a toothed belt 14 and a drive mechanism which is not illustrated here. Setting elements 15 are provided on flexible band 12 by means of which it is possible to set the distance between the revolving flat 13 and the surface of the carding cylinder, the so-called carding gap. The constructional design of such setting elements on the flexible bend are known from, for example, Applicants' German Utility Patent DE-U-93 13 633. In this case, however, setting elements 15 can not only be set manually but can also be adjusted automatically by means of an actuator system, for example, via small servomotors 17. This task can be performed, for example, via piezoelectric translators, model designations P-170 to P-173, manufactured by Physik Instrumente GmbH & Co. of D-7515 Waldbronn, Germany. This actuator system is connected with a control 16 which determines the setting of the flexible bend 12 and consequently of the carding gap, according to a setting characteristic as shown, for example, in FIG. 3.

Figure 3:
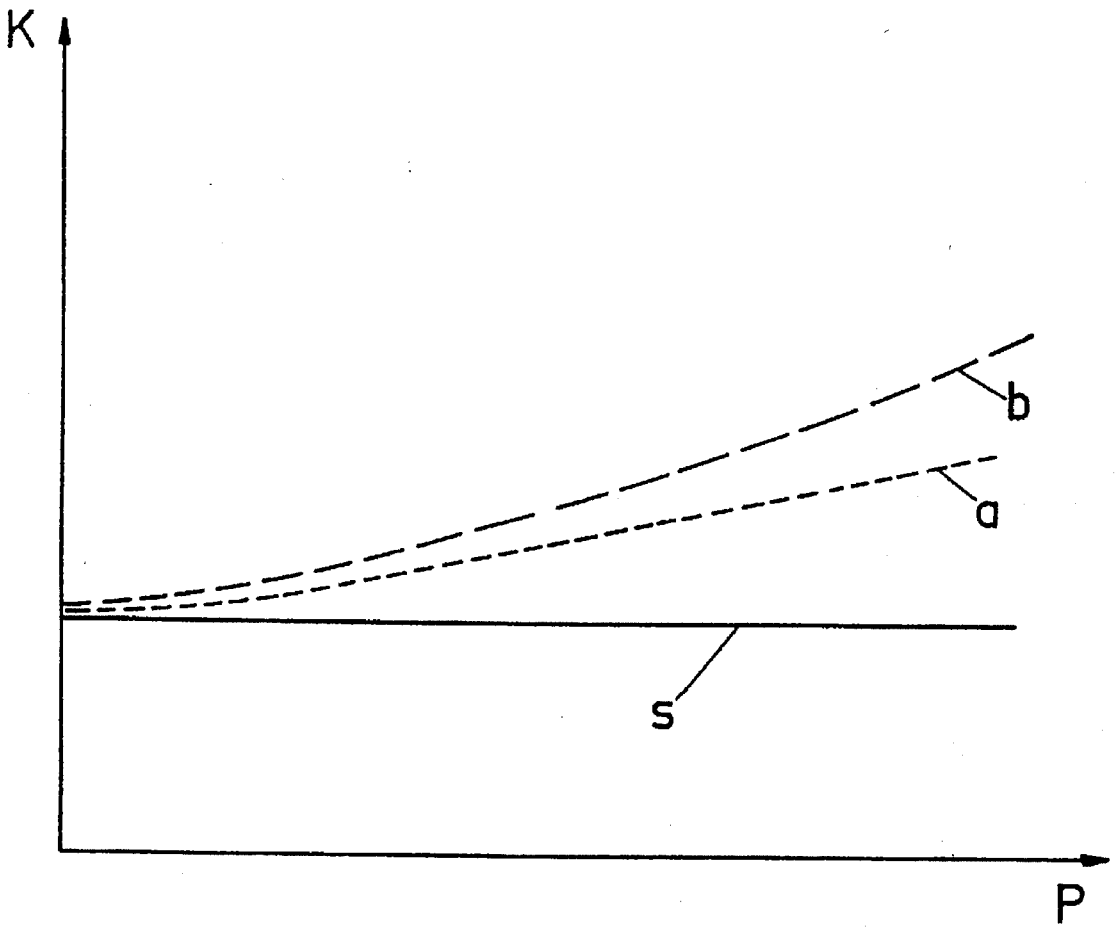
FIG. 3 show a graph of the progression of wear on the working elements of a revolving flat card which can be used as the basis for a control program for a machine of the type set forth in FIG. 2.

FIG. 3 is a diagram showing the change in the carding gap K, on the abscissa, in relation to the cumulative card sliver production P in tons (kg), on the ordinate, for different types of material being processed. The curve S represents the reference gap, i.e., the carding gap which would exist in the absence of wear of the carding cylinder clothing (and of the revolving flats). Depending on the type of production, there is then a greater or lesser degree of wear, indicated by the curves a and b for the different fiber materials A and B, which is determined by the carding work required to process a given material (influenced, for example, by the degree of soiling, fiber length and neps of the delivered fiber material). The degree of wear in relation to active production for the fiber materials of the different origins (A or B) is either known or empirically ascertainable, so that this data can be inputted or fed into the control 16 (FIG. 2) and the setting elements 15 can then be adjusted on the basis of this data.

The production of a card, at any given time, is a function of the delivery speed and the sliver count. At present, the total production of a card from a given point in time (e.g. from a card clothing change or card clothing service) is determined by a programmable control of the machine and displayed as required, i.e., this data is normally already available in the machine control. The "zero point" for calculation of this total production can obviously also be used as the zero point for controlling the adjustment of the carding gap. It is a prerequisite that the elements to be adjusted are in a predetermined state at the zero point, which must be ensured by the operating personnel. Otherwise, it becomes necessary to monitor the "initial position" of the elements by means of an appropriate sensor system and to relay this information to the control, thereby significantly increasing the required expenditure.

The adjustment characteristics can be programmed into the control by the machine supplier, i.e., the characteristic is entered into the control memory. The user can then call up the appropriate characteristic by entering the material type which is being processed.

It is preferable if the adjustment is not continuous but intermittent (in steps), depending on the capabilities of the actuator system. The actuator is preferably capable of reliably executing an adjustment which represents only a fraction, (e.g. a maximum of 20%) of the normal gap. These gaps currently lie within the range of 20 to 30 hundredths of a mm. It is preferable if the actuator is capable of reliably executing adjustment steps within the range of 1 to 3 hundredths of a mm.

The system is best suited for the user who processes a given type of material over longer periods of time. Calculation of the "total production" could prove to be extremely difficult with frequent changes of material.

If the type of material and supply remain unchanged over a long period and the efficiency can be anticipated, time rather than production can be used as a control parameter. The efficiency in this case is the actual production time within a given period of time.

Figure 4:
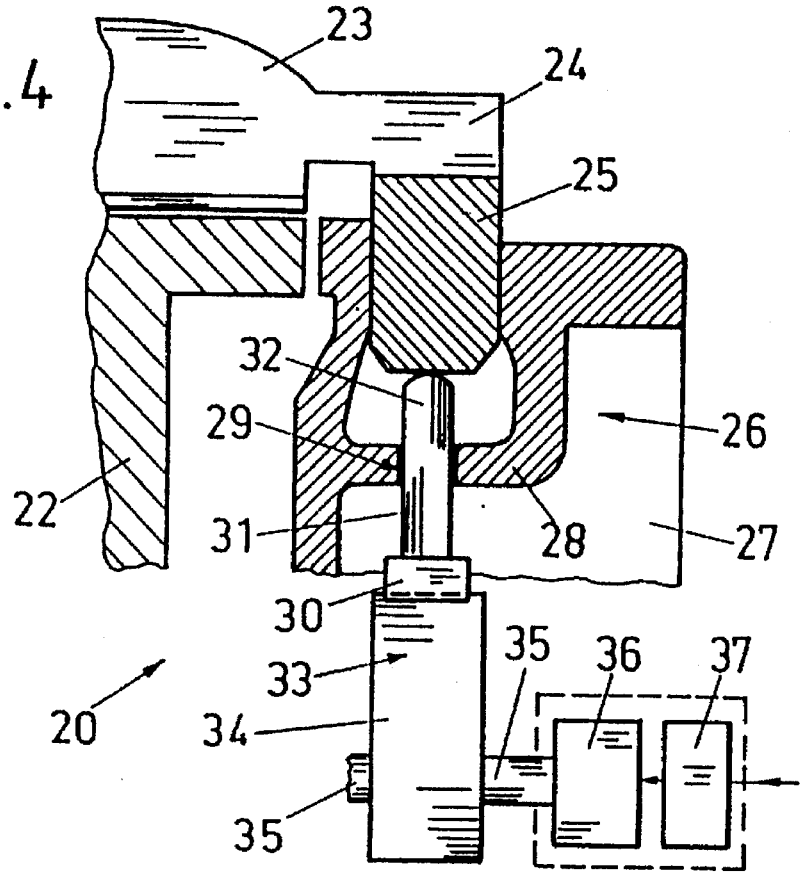
FIG. 4 shows a modification of the adjusting device set forth in German Utility Model DE-Gbm 93 13 633.

FIG. 4 shows a modification of FIG. 1 of German Utility Model DE-Gbm-93 13 633, for the purpose of adjustment by means of motors in accordance with this invention. This design also corresponds, in part, with the actuator system according to FIG. 13 of Applicants' own Swiss Patent Application No. 1681/93 (EP 94 810 309.8), or European Patent Application 0 627 508 A1.

FIG. 4 shows an adjustment device 20 on a card, in partial cross section. A partial section through the carding cylinder 22 of the card is shown on the left, with the profile of a flat bar 23 being shown at the top. The head piece 24 of this flat bar 23 is supported on a bearing, in this case a sliding or flexible bend 25, which is held virtually free from play with a supporting element 26 having a U-shaped profile. The U-shaped profile has an accurately-fitting slit in the region of the sliding or flexible bend 25 so that it is almost clamped within the supporting element 26. The U-shaped profile of the supporting element 26 is widened below the sliding or flexible band 25 so that the clamping effect, i.e., the accurate fit, is necessary only in the region of the sliding or flexible bend 25. This simplifies production, since exact machining (e.g. by grinding) is thus required only for these contact surfaces. In this case, the supporting element 26 is joined to the side shield 27, indicated in schematic form only, so as to form but one piece, however it can alternatively be a separate part which is joined to the side shield in a known manner, by means of screws or similar devices. The base 28 of the supporting element 26 has a bore 29 within which a setting element 31 can move freely in its longitudinal direction. At the foot of the setting element 31 there is a shoe 30, which will be explained in greater detail thereinafter. A flat, narrow groove can be provided on the shaft of the setting element 31, in its longitudinal direction, in which a setting scale is engraved so as to permit direct reading of the adjustment of the sliding or flexible band. Setting element 31 and shoe 30 are located outside the carding drum shield and are therefore always easily accessible. The head 32 of the setting element 31 is slightly rounded or crowned and is in contact with the underside of the sliding or flexible bend. The precise guidance of the sliding or flexible bend 25 within the supporting element 26 and the position of the contact point of the setting element on the flexible bend precludes the possibility of canting and provides for the simple and time-saving setting thereof.

Shoe 30 is received on a cylindrical surface 33 of an eccentric cam 34 which is mounted on a shaft 35 so as to rotate with shaft 35 around the longitudinal axis of the latter when an adjusting motor 36 is actuated. Motor 36 may, for example, be a stepping motor which can be actuated by a control unit 37 for the purpose of turning the shaft 35 through a number of steps defined by unit 37. Shaft 35 is mounted in the frame card (not illustrated) so as to achieve the rotary motion around its own longitudinal axis but no further movements.

The weight of the revolving flat set (only part of which is shown here) presses the flexible band 25 onto head 32 of setting element 31. Further elements of this type can be provided for the purpose of determining the curve of the bend relative to the carding cylinder (not shown), or only one adjustable element 31 may be provided for each bend 25, for example, according to FIG. 13 of previously noted Swiss application CH 1681/93. A duplicate of the arrangement, according to FIG. 4, must be provided, in mirror image, on the other side of the card in order to permit setting of the corresponding flexible bend.

The designs described above permit the carding gap to be adjusted automatically during production, in a particularly simple and cost effective manner, thereby avoiding unnecessary stoppage times. Alternatively, the resetting or adjustment of the carding gap can be dependent upon the grinding of a card clothing, particularly the automatic grinding of the carding cylinder clothing. This substantially increases the operating times of the carding machines in a spinning operation without incurring any significant loss of quality. A design suitable for this purpose is described below with reference to FIG. 5, with this figure being a combination of FIG. 2 of European Patent Publication EP-A-565 486 and FIG. 13 of Swiss Patent Publication CH 1681/93 (EP 94 810 309.8) with additions according to this invention. A brief description will be made of the controlled grinding according to European Patent Publication EP-A-565 486. Reference should be made to the complete EP document for the details of the method and for the arrangement of the system.

Figure 5:
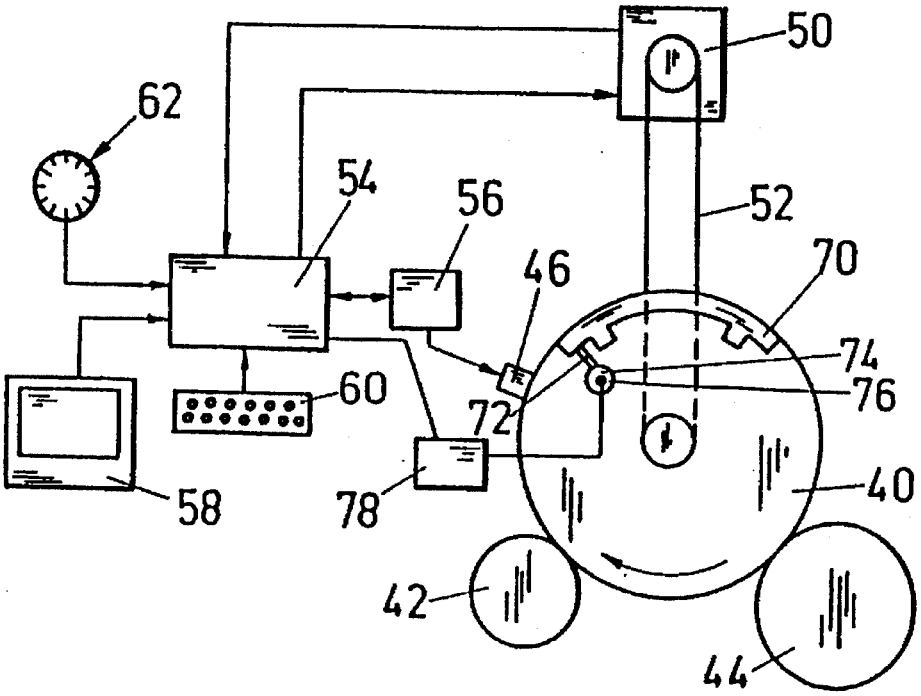
FIG. 5 is a copy of FIG. 2 of European Patent Publication EP-A-565 486 with additions in accordance with this invention.

FIG. 5 shows, in schematic form, the carding cylinder 40, the licker-in 42, the doffer 44 and the grinding system which is indicated as a whole by reference numeral 46. System 46 comprises a grinding stone, its holder, a drive motor and a guide means (not shown) which guides the grinding stone holder over the width of the card during one traverse motion. These latter elements are described in greater detail in EP-A-565 486 and will not be repeated here. FIG. 5 also shows the drive motor 50 for the card which rotates the carding cylinder 40, for example by means of a toothed belt 52, when the card is in operation. The motor 50 is controlled by signals from a card control 54 and signals its status back to this control 54. Card control 54 also controls the grinding system 46, it being assumed in the illustrated example that the grinding system possesses its own "sub-control" 56 which automatically executes certain control functions using control commands from the main control 54.

Main control 54 has a display 58 and a keyboard 60 for operator-machine communication. Controller 54 also includes a time signal generator which is indicated schematically by reference numeral 62.

Main control 54 passes the following control commands to sub-control 56:

a) the number of stroke movements of the grinding stone during a defined operating phase;
b) the operating speed of these motions (alternatively, this can be programmed into the sub-control 56); and
c) a start signal for initiating an operating phase.

The different phases (and the corresponding control commands or machine settings to be entered by the operator) will now be described in greater detail with reference to FIGS. 6 and 7.

Figure 6:
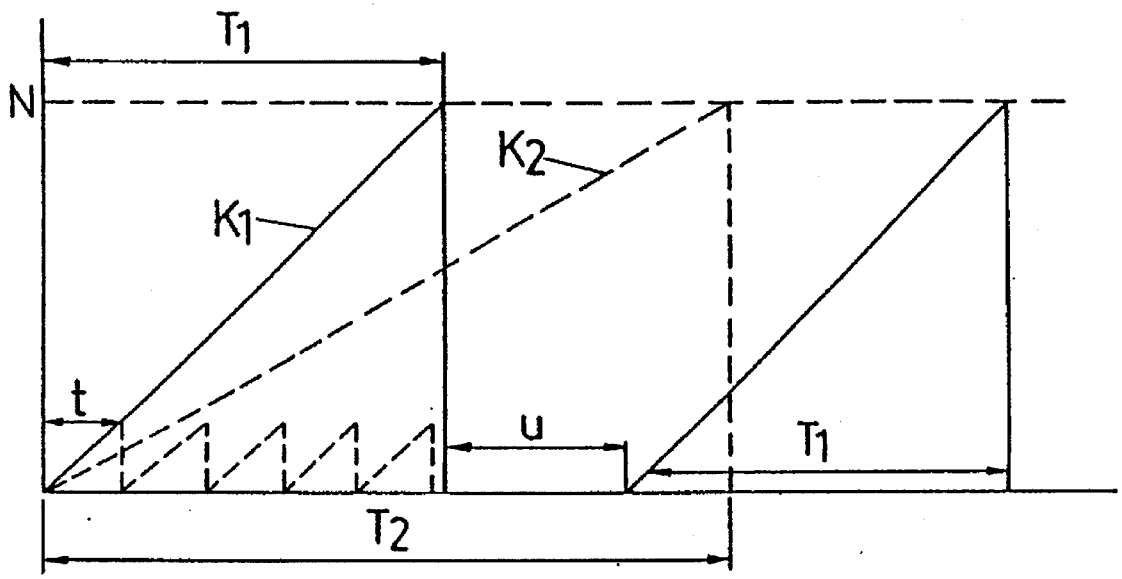
FIGS. 6 and 7 are copies of FIGS. 3 and 4 of European Patent Publication EP-A-565 486, respectively, and serve for the purpose of explaining the controlled grinding of card clothing.

FIG. 6 is a time diagram which serves to explain the duration of each readiness or waiting phase. This diagram is not an actual representation of reality, but purely a theoretical diagram intended for the explanation of the principles involved.

In FIG. 6, the time is set forth on the horizontal axis and tooth wear of the carding cylinder is set forth on the vertical axis. The "curve" K1 represents the increasing tooth wear for a period T1 of uninterrupted operation with a predefined carding cylinder rotational speed and a given processed material. The "wear" in this case refers to tooth attrition which results in an impairment of the functional capability of the tooth as a carding element. This is explained more fully below with reference to FIG. 7. Different operating conditions (rotational speed of the carding cylinder and material being processed) will result in the wear occurring more slowly (e.g. as in the curve K2) or even more rapidly (not illustrated), the latter producing a steeper curve characteristic.

In FIG. 6 it is assumed that at "N" the tooth wear has reached such a level that grinding is necessary. This level is not absolute, but can be determined in the spinning operation at its own discretion according to its production program (orders). The decision is made e.g. on the basis of the delivered card sliver quality, e.g. according to the neps level. The (rather unrealistic) assumptions of the illustrated example produce a maximum operating time T1 for the operating conditions of the curve K1 and a maximum operating time T2 for the curve K2 until the card (without use of a built-in grinding system) would have to be stopped and partially disassembled for grinding of the card clothings. In this case, operation has continued over an extended portion of this period T1 (or T2) with a substantial degree of tooth wear. Grinding then produces an interruption u until the card can reassume operation for a further period T1 (or T2).

The continuous use of a built-in grinding system (such as the system 46 in FIG. 5) means that it is possible to keep the effective tooth wear (i.e. that determines the product quality) at virtually zero. This, however, represents an expensive mode of operation because a certain degree of tooth wear does not result in significant losses of quality, i.e., it is quite acceptable. Accordingly, in the case of the operating conditions of the curve K1, it is possible to allow the card to operate, for example, for an operating time t without any measurable effect upon product quality. At the end of this operating time t, the system 46 (FIG. 5) is actuated in order to initiate a predefined number of stroke movements of the grinding stone, this restoring the effective wear to zero without interrupting operation. A possible means of controlling the number of stroke movements will be explained below with reference to FIG. 7. A preferred solution is set forth hereinafter, towards the end of the description.

The operating time t (without use of the grinding system) is equal to the period of readiness of the grinding system 46. During this period, the grinding stone waits in its end position, or stands ready for use in this end position. The time t can be entered into the control 54 by the operator by means of the keyboard 60 (and called up again for verification via the display 58). Test settings can be used initially to determine the "optimum" conditions and the determined values can then be definitively entered for normal operation.

It may, however, be the case that the "optimum" waiting period t decreases over the lifetime of a given card clothing (i.e. until the card clothing is renewed), i.e., the duration of this waiting period will often prove to be a function of the total operating time of the card clothing. This can be taken into account by control 54 by means of an operating hour meter and messages from both the motor 50 and the time signal generator 62. Motor 50 (which drives the carding cylinder) is shown only by way of example as a source for the signals which control the operating-hour meter. Such signals could also be received, for example, from the doffer drive and would thus exhibit a closer relationship to the throughput of the material.

Following the reclothing, the operator must enter the appropriate operating time function and a start signal which enable the control 54 to determine the correct points in time for the application of the grinding system. At the end of each waiting period, control 54 sends a start signal to subcontrol 56 to indicate the operation of the grinding system. The subsequent operation will now be described with reference to FIG. 7.

Figure 7:
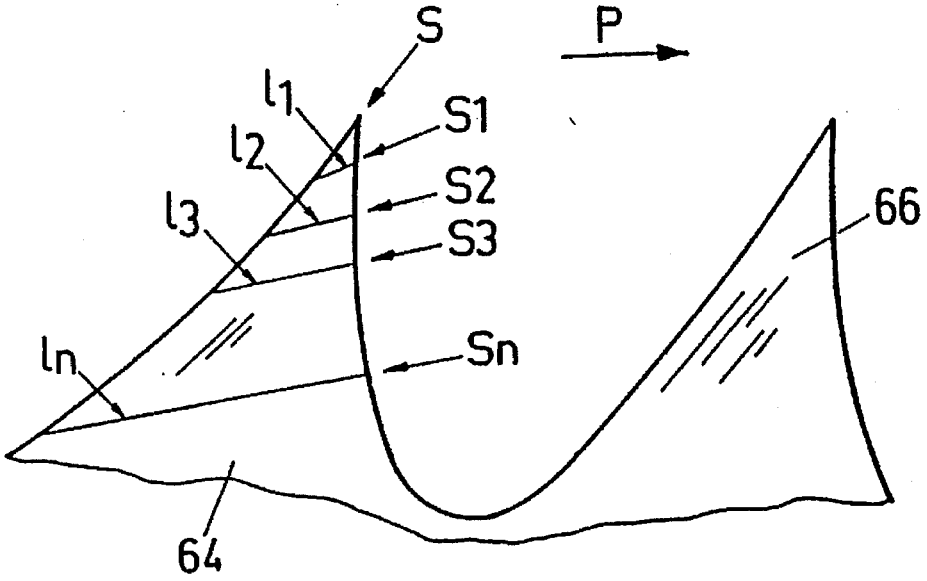

FIG. 7 shows, in diagrammatic form, two teeth 64, 66 of a card clothing and their direction of movement P. The work of the tooth is performed at the tip S and the wear at this point determines the product quality. The technology of the carding process (the product quality) is dependent upon the sharpness of the tip at the foremost edge of each tooth 64, 66, etc. Grinding (all types) reduces the height of the tooth, so that a sharp tip S1, S2, etc. is restored to the leading edge during each grinding operation. This can be continued until a very low tooth height is reached, e.g. as far as the tip Sn (FIG. 7), where the tip adjoins the region merging into the next tooth.

FIG. 7 shows that the carding gap is necessarily changed with each grinding operation unless it is reset. This then can be effected by means of an actuator system, for example according to the modifications made to FIG. 2 of already previously noted EP-A-565 486, which are shown in FIG. 5 of the noted application and will now be described below.

On each side of the card there is a flexible bend 70 (indicated in schematic form only). The machine frame (not shown) includes a guide (not shown) for a setting element 72, similar to the example of the setting element 31 (FIG. 4), which acts together with an eccentric cam 74. The cam is rotated by a motor 78, through a shaft 76, when the motor 78 is thus actuated by card control 54. The same control 54 then controls both the grinding, by means of unit 46, and the adjustment of the flexible bend (of which only one bend 70 is shown in FIG. 5), by means of motors 78 (one on each side of the card).

Depending upon the programming of control 54, a variety of combinations is then possible, namely:

1. Grinding and adjustment are each controlled individually, i.e., independently of each other (initiated by the program);
2. adjustment is initiated following a grinding operation; and
3. adjustment and grinding can be initiated independently of each other, and the adjustment can also be initiated following a grinding operation.

The preferred solution is that of adjustment following a grinding operation and, in particular, after a number of grinding operations, determined by the control, have been executed. Adjustment may be initiated only after several grinding operations, e.g. only when the tip S2 (FIG. 7) or even the tip S3 is reached. The number of operations can be programmed. Adjustment, which can likewise be programmed, then depends on both the specified number of operations and the intensity of grinding.

According to an advantageous modification of the program as per FIG. 7, the application of the grinding system is not controlled strictly according to time, but according to production. To this end, the user can enter into the control the duration of the service life which he desires from the card clothing, measured by volume of material to be produced. (tons). The control can then determine, on the basis of a predefined characteristic stored in its memory, how frequently grinding must be carried out. This characteristic must be matched to the type of material and/or type of card clothing, or the appropriate type must be called up from the memory by the user. This characteristic determines both the total number of grinding cycles (e.g. double stroke of the grinding stone) over the preset service life of the card clothing and the distribution of these grinding cycles over the service life.

Adjustment of the flexible bend can then be controlled on the basis of the same characteristic since it is probable that only after a few grinding cycles does it become possible for the change in the tooth shape to be accommodated by adjustment of the bend.

The use of the actuator system for compensating the effect of the grinding is obviously not limited to the combination of a grinding operation controlled by the machine. For example, the user could enter a signal into the control which effects an adjustment defined by the user. These signals could be defined in an operating handbook for grinding, even if it is necessary for a grinding device to be mounted on the card and then subsequently removed. Preprogrammed "adjustment steps" could even be initiated by the user, with the time for execution of the adjustment being determined by the user himself.

The use of the actuator system for compensating the effect of the tooth wear (without considering grinding) is likewise not limited to the solution according to FIG. 3. For example, it may be sufficient, in a simplified solution, for the operation of the adjusting actuator system to control solely according to production (without taking account of the type of material).

Naturally, the actuator system can be used to compensate for the effects of wear on the clothings of the carding cylinder and/or of the flat bars, i.e. the invention is not limited to the consideration of the wear of the carding-cylinder clothings.

A modern conventional card is of considerable size—see, for example, the comparative values given in European Patent Publication EP-A-446796. Here it is necessary to adhere exactly to the carding gap settings and certainly at all points—i.e. across the entire working range of the flat bars. It is therefore desirable to guide the flexible bend to several positions and to re-guide when resetting, as will now be explained by means of FIGS. 8 to 12. For the time being, FIGS. 10 and 11 are explained rather cursorily since they are merely shown in order to explain the terminology used hereinafter so as to explain the other drawing figures.

Figure 10:
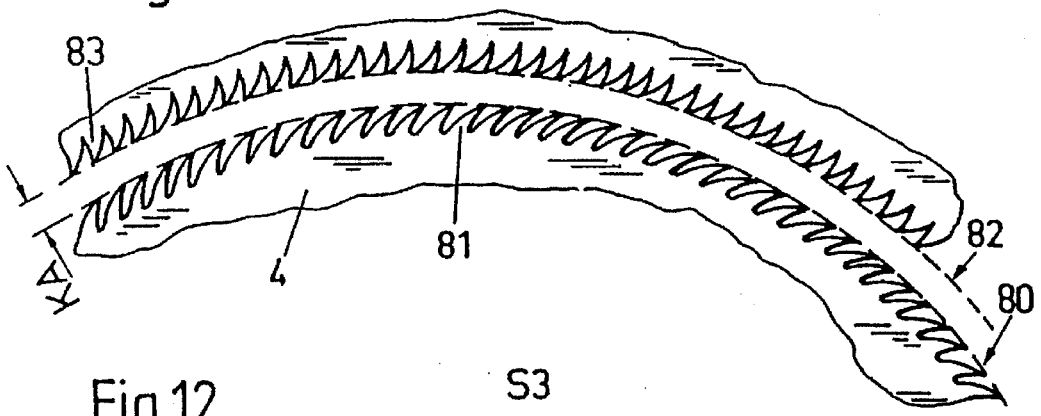
FIG. 10 is a schematic representation of the card gap.

Curve 80 in FIG. 10 represents the impact circle (or the "shell surface") of the tips of the clothing 81 which is carried by the carding cylinder 4. The curve 82 represents the impact circle (or the shell surface) of the tips of the clothing 83 which is carried by the flat bars 13 (FIG. 2). In FIG. 10 the division of the clothing 83 into part clothings on the various flat bars 13 has been ignored since such a division is unnecessary for the required explanation. On account of this division the effective impact circle is, in practice, not the segment of a curve but a polygon which however closely resembles the segment of a curve. The carding distance KA is the distance of impact circle 82 from the impact circle 80. This distance is usually intentionally variable over the length of the flexible bend—it is relatively large at the inlet (where a flat bar comes into contact with the flexible bend) and relatively small at the outlet (where the flat bar again lifts from the flexible bend).

Figure 11:
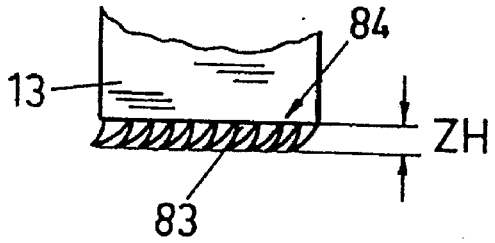
FIG. 11 is detail of the arrangement of FIG. 10.

Since FIG. 11 depicts only a detail on a fairly large scale, only a single flat bar 13 appears here with a part of the "clothing" 83 in accordance with FIG. 10. Flat bar 13 has a sliding surface 84 which slides on a sliding surface 85 (FIG. 8) on flexible bend 12. The dimension ZH in FIG. 11 represents the tooth height and the distance between the impact circle 82 and sliding surfaces 84 and 85. The carding distance KA changes, while the card is working, and the reasons for this have already been explained in this description and in European Patent Publications EP-A-384297, EP-A-627508 as well as German patent Publication DE-A-4235610.

Figure 8:
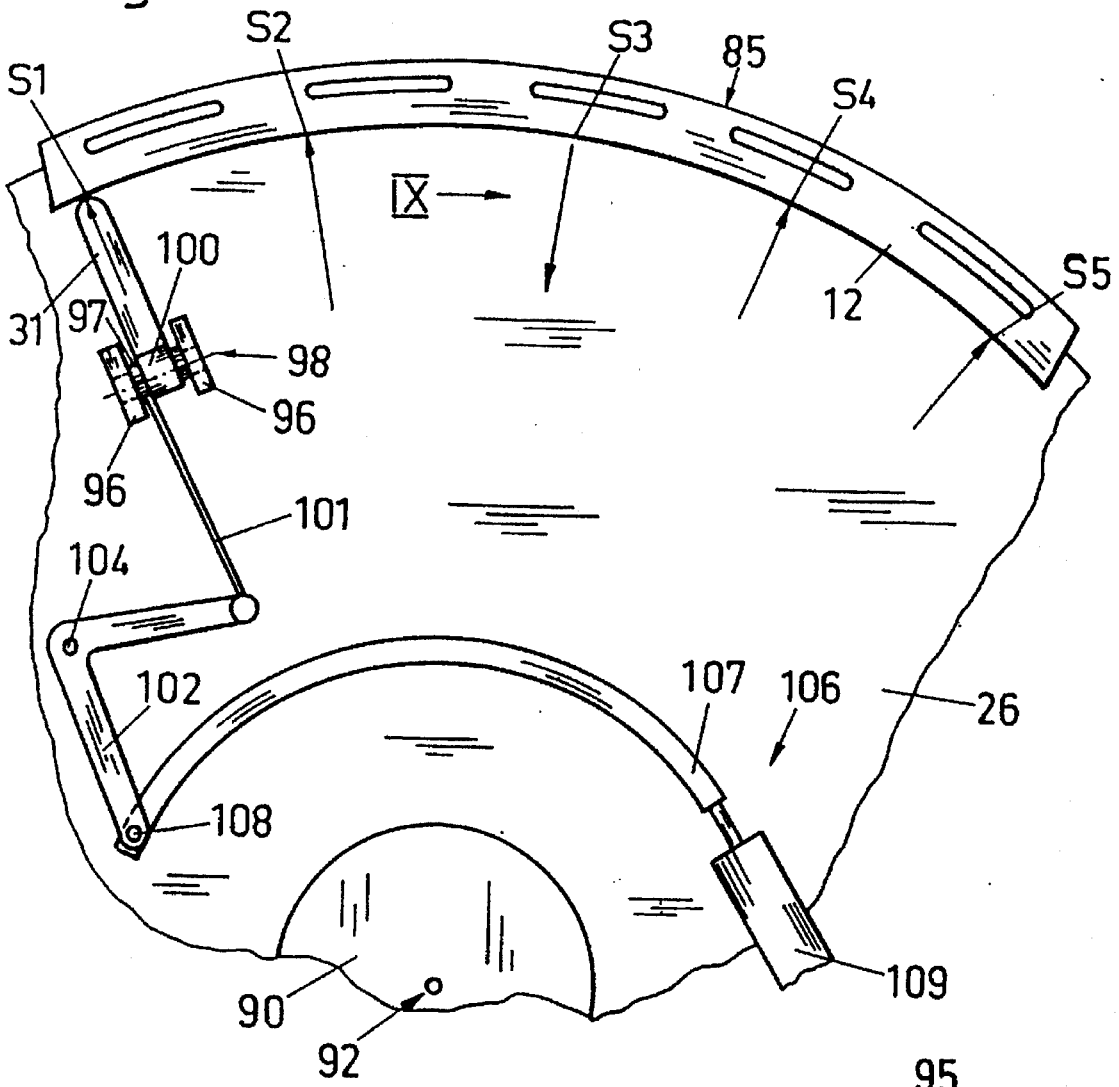
FIG. 8 is a schematic showing of the side shield of the card of this invention which sets forth the preferred solution thereof.
Figure 9:
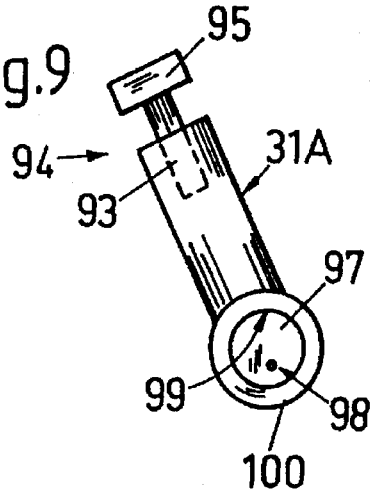
FIG. 9 is a detail of the arrangement of FIG. 8, looking in the direction of arrow IX in FIG. 8.

The object of the solution in accordance with FIGS. 8 and 9 is to be able to intermittently restore the once correctly set carding distance KA (together with any variability along the flexible bend) via the balancing of the effects of wear, whilst the card is still operating.

To this end, flexible bend 12, according to FIG. 8, is guided at five point S1 to S5 (hereinafter called control points) indicated in each case by arrows, and supported relative to the side shield 26. Shield 26 includes a bearing portion 90 which defines the axis of rotation 92 of carding cylinder 4. Each setting point S1 to S5 has its own setting element 31 assigned thereto, though for the sake of simplicity, only one such element 31 is shown in FIG. 8 and another such element 31A in FIG. 9. Each of the elements 31, at the setting points S1, S2, S3 and S5, has a rounded head on which the bend 12 is supported or against which the bend 12 is drawn by the element 31A at setting point S3. The latter element (FIG. 9) has a tapped hole 93 for accepting a pin 94, the head 95 of which is held in a cutout (not shown) in flexible bend 12, so that the bend is gripped between head 95 and the end of element 31A and has to move with the element.

The adjusting mechanism is identical for all elements 31, 31A so that it is sufficient to describe only one example. It includes two shoulders 96 which are fixed next to each other on the shield 26 (or are cast with the shield in a single piece) and a pin 97 which is carried between the shoulders 96 and can rotate about an axis 98. The center part of pin 97 (between the shoulders 96) has a cylindrical surface 99 (see FIG. 9), which is formed eccentrically relative to the axis of rotation 98. Each setting element 31, 31A is provided with a connecting ring 100 which accepts the eccentric middle part of the pin 97 without play. When pin 97 rotates about axis 98 the element therefore moves in one or the other radial direction relative to the axis of rotation. A guide (not shown) may be provided on the shield 26 in order to ensure straight line movements of elements 31, 31A.

Each pin 97 is connected to a rotary handle 101, for the purpose of exerting torque thereon. Each rotary handle 101 has a rocker arm 102 assigned thereto which is able to rock about a rotary axis 104 borne by shield 26. The rocking movement of all arms 102 is effected by a common actuating device 106. This device is comprised of a rail 107 which is guided in a guide (not shown) carried by the shield, and in such a manner that it is able to move in its own longitudinal direction about axis 92. Since the rail 107 is connected to each rocker arm 102 (e.g. at point 108, FIG. 8), the movements of the rail 107 are, at the same time, transferred to all arms 102 and to all elements 31, 31A.

One movement of the rail 107 is effected by a suitable, controllable drive mechanism 109. An electric cylinder with a displacement measuring device is suitable as a drive mechanism 109, with the results of the displacement measurement being passed on, over signal lines, as control signals, to a control (not shown in FIG. 8; see, however, FIG. 5).

FIG. 8 only shows bend 12 on one side of the card. The other side is provided with a second bend 12 with its own elements 31, 31A, eccentric pins 97, arms 101, 102 and actuating device 106. The two bends 12 can therefore be set independently of each other. The principle of adjustment and readjustment will be explained hereinafter via FIG. 12 which is to be understood however to be a purely schematic representation (with no reference to reality regarding the sizes of the elements).

Assuming that the card is initially set so that at operating temperature and operating speed a sliding surface 85A of the flexible bend is presented to the impact circle 80A of the carding cylinder clothing. Assuming further that the impact circle 80A is circular about the axis of rotation 92 (also see FIG. 8), with the sliding surface 85A also being circular, or can be "adjusted" relative to the carding cylinder in order to achieve a variable carding distance in the working range of the flat bars.

Figure 12:
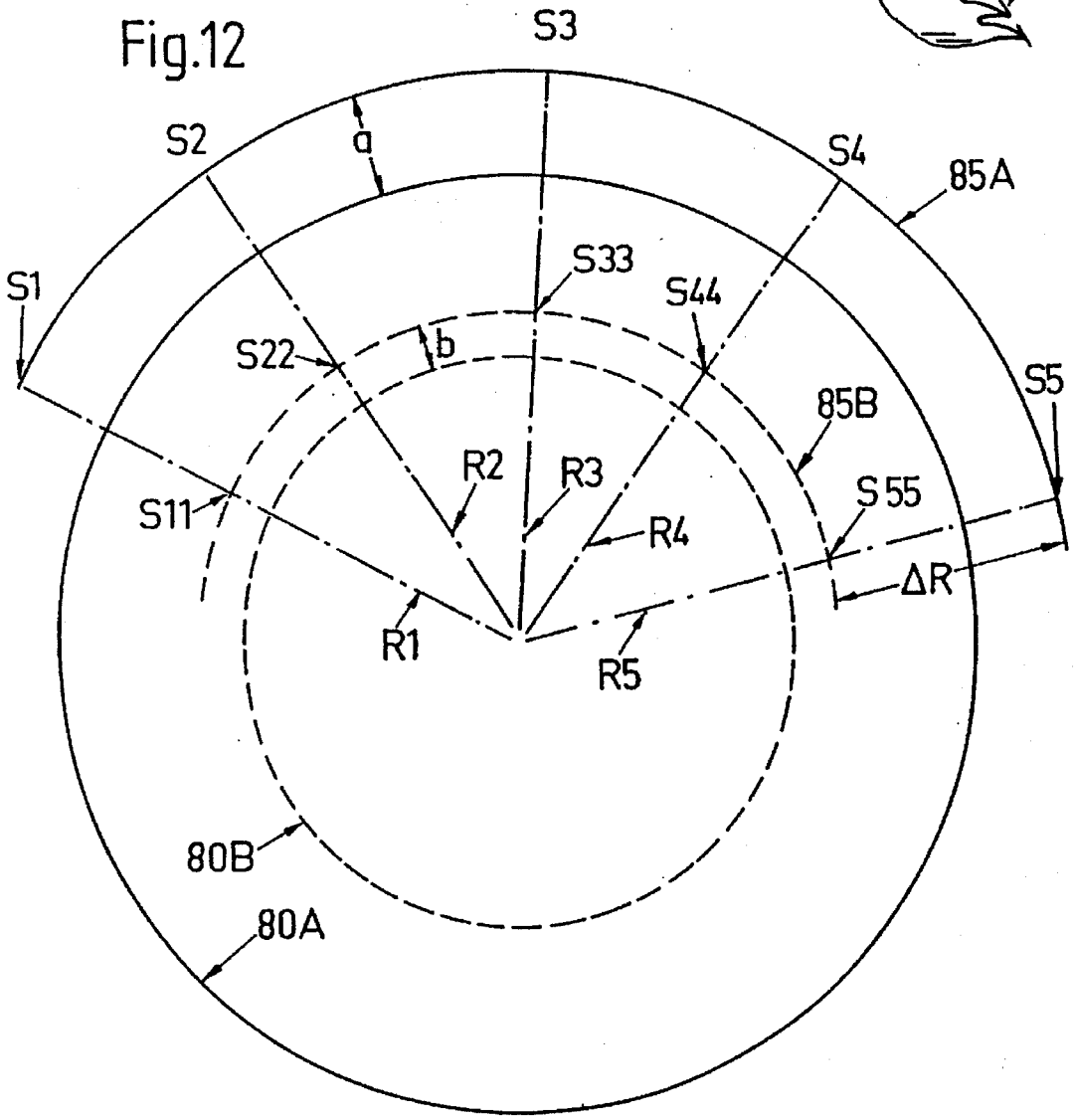
FIG. 12 is a diagram for explaining the working principle of the preferred solution of this invention.

Now, let it be assumed that the impact circle of the carding-cylinder clothing contracts during the operation of the card to that of 80B (with the dimensions here having been greatly exaggerated in the interest of pictorial representation). The sliding surface 85 is intended to follow the impact circle, whereby however the carding distance (together with any variability) is kept as constant as possible. The curvature of the sliding surface 85 must therefore be changed if only to take account of the change of curvature of impact circle 80. In the representation of FIG. 12, sliding surface 85A may not simply travel downwardly, it must adapt itself also to the altered radius of impact circle 80.

The setting points S1 to S5, where the setting elements touch the bend 12, must therefore move along each of the radii R1 to R5 which intersect at the axis of rotation 92 and in the process they must all travel the same path R behind each other, e.g. S1→S11, S2→S22, S3→S33, S4→S44 and S5→S55.

If now only the wear to the carding-cylinder clothing has to be taken into account, then the path ▲R is the same as the radial distance between impact circle 80A and impact circle 80B. However, resetting now makes no contribution towards making an allowance for any wear on the clothing of flat bars 13. To compensate for this wear, sliding surface 85 can be brought closer to impact circle 80 so that the distance "a" between sliding surface 85A and impact circle 80A is greater than the distance "b" between impact circle 85B and impact circle 80B.

In this connection, the term "wear" includes both the wear caused by material processing and the loss due to grinding. Setting now requires the following steps:

1. With the assistance of a blade gauge (or another suitable instrument) a "basic position" is recorded. As before, this step is time-consuming and troublesome, requiring both skill and experience. However, unlike the process heretofore, it will be possible in future to restore the basic setting relatively easily by readjustment in accordance with the invention.
2. When readjusting, the flexible bend is reset either in accordance with a predetermined program (e.g. according to FIG. 5) or according to information (commands) inputted by the operating personnel.
3. For the sake of safety some checks on each side can be made occasionally. However, since the bend is adjusted as a whole, the movements being linked together at all control points, the conditions prescribed by the basic setting are also maintained when adjustment takes place.
4. What has to be checked is the amount of the adjustment and size or extent of the steps. This must be specified using empirical values for the effective wear.

A device in accordance with this invention, however, can find a wider application than just again compensating the effect of wear. The following changes or abnormal conditions can also be taken into account through adjustment:

Carding-cylinder clothing replacement;

Flat set replacement;

Flat clothing replacement;

Compensating for a "conical carding-drum"; and

Compensating for a "conical flat set".

The last two procedures require differences in the adjustment of the two card sides. The device can naturally be used if a conventional grinding process is used, e.g. if the carding drum clothing is ground using a grinding roller stretching across the width of the card.

While there are shown and described present preferred embodiments of the invention, it is to be distinctly understood that the invention is not limited thereto, but may be otherwise variously embodied and practiced within the scope of the following claims and the reasonably equivalent structures thereto. Further, the invention illustratively disclosed herein may be practiced in the absence of any element which is not specifically disclosed herein.

What is claimed:

1. A method for producing a card sliver using a carding machine including working elements wherein the condition of the working elements deteriorates as the machine operating time increases, the method comprising:

periodically resetting the working elements to compensate, at least partially, for the deterioration in the condition of the working elements;

effecting the resetting of the working elements via a controllable actuator system, the resetting initiated by a control; and providing the control with a control program for initiating the resetting on the basis of a wear characteristic, the wear characteristic depending upon actual machine production.

2. The method of claim 1, wherein the wear characteristic is also dependent on the characteristics of a material being processed in the machine.

3. The method of claim 1, wherein the resetting involves setting points, with the setting points moving radially relative to the carding cylinder.

4. The method of claim 1, wherein the card includes opposed sides and wherein the resetting is carried out in steps and involves setting points, with each setting point on one side of the card moving over the same path.

5. The method of claim 1, wherein the resetting is achieved by readjusting at least one flexible bend.

6. The method of claim 5, further including, simultaneously readjusting the flexible bend at several points.

7. The method of claim 1, further comprising:

measuring a production of card slivers as a function of a delivery speed and a sliver count.

8. The method of claim 7, further comprising:

initiating the measuring the production step at a zero point, the zero point also indicating an initiating point for controlling an adjustment gap.

9. The method of claim 1, further comprising:

programming adjustment characteristics into the control based upon each of a plurality of material types to be processed; and accessing a specific programming adjustment characteristics by entering a specific one of the plurality of material types, the specific one entered being processed.

10. The method of claim 1, the resetting is performed intermittently.

11. A carding machine comprising:

working elements and a mechanism for resetting the working elements to compensate, at least partially, for a deterioration in a condition of the working elements;

a controllable actuator system for effecting the resetting;

a control for initiating the resetting including a memory unit for storing a wear characteristic for the working elements which is dependent on machine production;

the control, via the machine production and an actuator system, acting on a setting mechanism for the working elements for at least one of for automatically adjusting the working elements and for improving the working elements at time intervals determined by the control.

12. The carding machine of claim 11, wherein the wear characteristic is also dependent on the characteristics of a material being processed in the machine.

13. The carding machine of claims 11, wherein the control adjusts the setting elements of a flexible bend on the revolving flat card.

14. The carding machine of claim 11, wherein the card includes opposed sides and the actuator system simultaneously resets the control elements for each of the card sides.

15. The carding machine of claim 14, wherein the actuator system of one card side includes a common drive for all setting elements of the one side.

16. The carding machine of claim 11, wherein the actuator system includes at least one setting element, the setting element being subject to tensile loading during resetting.

17. The carding machine of claim 11, further comprising:

a measuring device for measuring a production of card slivers as a function of a delivery speed and a sliver count.

18. The carding machine of claim 17, further comprising:

the measuring device initiating measuring the production step at a zero point, the zero point also indicating an initiating point for controlling an adjustment gap.

19. The carding machine of claim 11, the stored wear characteristic including a plurality of stored adjustment characteristics based upon a respective plurality of material types to be processed; and the carding machine further comprising:

a device for entering a specific one of the plurality of material types being processed.

20. The carding machine of claim 11, the control intermittently performing the resetting.

* * * * *